US006563365B2

(12) United States Patent
Knierim et al.

(10) Patent No.: US 6,563,365 B2
(45) Date of Patent: May 13, 2003

(54) LOW-NOISE FOUR-QUADRANT MULTIPLIER METHOD AND APPARATUS

(75) Inventors: Daniel G. Knierim, Beaverton, OR (US); Barton T. Hickman, Portland, OR (US)

(73) Assignee: Tektronix, Inc., Beaverton, OR (US)

( * ) Notice: Subject to any disclaimer, the term of this patent is extended or adjusted under 35 U.S.C. 154(b) by 0 days.

(21) Appl. No.: 09/758,533

(22) Filed: Jan. 10, 2001

(65) Prior Publication Data

US 2001/0033192 A1 Oct. 25, 2001

Related U.S. Application Data

(60) Provisional application No. 60/175,996, filed on Jan. 11, 2000.

(51) Int. Cl.[7] ..... G06G 7/12
(52) U.S. Cl. ..... 327/355; 327/357
(58) Field of Search ..... 327/357, 355, 327/358, 359, 356; 485/326, 333; 330/252, 253, 254, 261

(56) References Cited

U.S. PATENT DOCUMENTS 5,587,682 A * 12/1996 Colli et al. ..... 327/357
5,602,509 A * 2/1997 Kimura ..... 330/253
5,774,010 A * 6/1998 Kimura ..... 327/356
5,883,539 A * 3/1999 Kimura
5,925,094 A * 7/1999 Kimura ..... 327/357

* cited by examiner

*Primary Examiner*—Timothy P. Callahan
*Assistant Examiner*—Linh Nguyen
(74) *Attorney, Agent, or Firm*—James G. Stewart; Thomas F. Lenihan

(57) ABSTRACT

A method for reducing noise in a four-quadrant multiplier having first and second cross-coupled pairs of differential bipolar transistors, differential input current terminals connected with a first pair of common junctions of the respective pairs of differential transistors and the differential output current terminals cross coupled to form a second pair of common junctions of the respective pairs of differential transistors is described. The method includes providing a noise current path from the differential input current terminals to a bias voltage, the noise current path substantially bypassing the differential output current terminals when the gain of the multiplier is near zero. Preferably, the first junctions are common emitter junctions and the second junctions are common collector junctions, and the noise current path comprises a third pair of transistors having respective emitters connected to the common emitter junctions, having common collectors connected to a bias voltage and common bases connected to a controlling voltage. Overall output noise is substantially reduced, as the current through the differential transistor pairs is shunted instead to the bias voltage, effectively ensuring that no noise current reaches the differential output terminals when the current through the differential transistor pairs is zero, i.e. when the gain of the multiplier is zero.

17 Claims, 2 Drawing Sheets

LOW-NOISE FOUR-QUADRANT MULTIPLIER METHOD AND APPARATUS

This application claims the benefit of Provisional application Ser. No. 60/175,996, filed Jan. 11, 2000.

BACKGROUND OF THE INVENTION

The present invention relates generally to multipliers, and more particularly to a four-quadrant multiplier that exhibits lower noise than prior art four-quadrant multipliers.

SUMMARY OF THE INVENTION

A method for reducing noise in a four-quadrant multiplier having first and second cross-coupled pairs of differential bipolar transistors, differential input current terminals connected with a first pair of common junctions of the respective pairs of differential transistors and the differential output current terminals cross coupled to form a second pair of common junctions of the respective pairs of differential transistors is described. The method includes providing a noise current path from the differential input current terminals to a bias voltage, the noise current path substantially bypassing the differential output current terminals when the gain of the multiplier is near zero. Preferably, the first pair of junctions are common emitter junctions and the second pair of junctions are common collector junctions, and the noise current path comprises a third pair of transistors having respective emitters connected to the common emitter junctions, having common collectors connected to a bias voltage and common bases connected to a controlling voltage. Overall output noise is substantially reduced, as the current through the differential transistor pairs is shunted instead to the bias voltage, effectively ensuring that no noise current reaches the differential output terminals when the current through the differential transistor pairs is zero, i.e. when the gain of the multiplier is zero.

DETAILED DESCRIPTION OF THE INVENTION

Figure 1A:
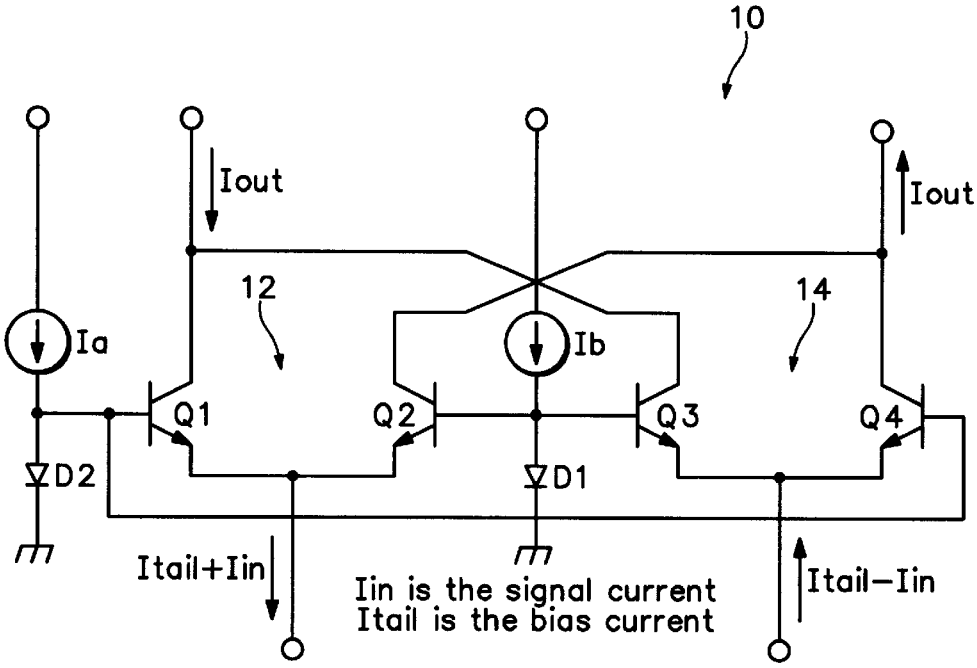
FIG.1A PRIOR ART
FIGS. 1A and 1B are a schematic diagram illustrating a convention four-quadrant multiplier and a graph illustrating its gain versus current characteristics.

FIG. 1A is a schematic diagram of a conventional four-quadrant multiplier indicated at 10. Conventional multiplier 10 typically includes a first differential transistor pair Q1/Q2 indicated at 12 and a second differential transistor pair Q3/Q4 indicated at 14. Those of skill in the art will appreciate that multiplier 10 is of the well-known Gilbertype and operates in accordance with well-known principles which will be briefly summarized here.

First transistor pair Q1/Q2 have their emitters E1/E2 connected together in a first emitter junction 16 connected in turn to a first differential input terminal Itail+Iin (where Itail will be understood to be the bias current and Iin will be understood to be the signal current). Collector C1 of transistor Q1 is connected to a first differential output terminal Iout1, while collector C2 of transistor Q2 is connected to a second differential output terminal Iout2.

Second transistor pair Q3/Q4 have their emitters E3/E4 connected together in a second emitter junction 18 connected in turn to a second differential input terminal Itail-Iin. Collector C3 of transistor Q3 is connected to first differential output terminal Iout1, while collector C4 of transistor Q4 is connected to the second differential output terminal Iout2.

Those of skill in the art will appreciate that Itail is a relatively large sink current source that ensures the forward bias of the base-emitter junctions of transistors Q1, Q2, Q3, Q4 and their operation in their respective forward active regions.

The bases of transistors Q2, Q3 are connected in common to a first current source Ib and through a first diode D1 to a baseline voltage, e.g. ground. The bases of transistors Q1, Q4 are connected in common to a second current source Ia and through a second diode D2 to a baseline voltage, e.g. ground. It will be understood by those of skill in the art that current sources Ia and Ib and their respective, grounded diodes D2, D1 effectively linearize the operation of multiplier 10. They do so by shaping the base voltages of transistors Q1, Q2, Q3, Q4 as an inverse hyperbolic tangent function to compensate for the hyperbolic tangent function intrinsic to the bipolar transistors' operation. Ia, Ib and D2, D1 also determine how much of the differential input current being multiplied flows through which transistor, as may be seen by brief reference to FIG. 1B.

Figure 1B:
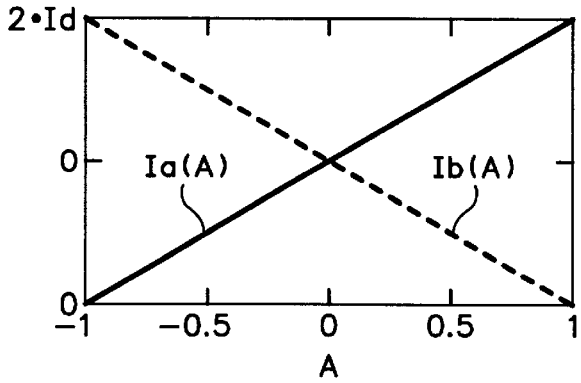
FIG.1B PRIOR ART

The gain A of conventional four-quadrant multiplier 10 is determined by the diode currents according to the formula A=(Ia—Ib)/(Ia+Ib). The graph of FIG. 1B illustrates one simple method of setting the drive currents through current sources Ia (solid line) and Ib (dashed line). Those of skill in the art will appreciate that the current sources are linear and complimentary to one another, and that their combination determines the gain of multiplier 10. Each ranges from 0 to 2·Id, wherein Id is the average current through diodes D2, D1. Thus, complimentary control of Ia and Ib may be seen to linearly control gain A of multiplier 10, as is known.

Those of skill in the art will appreciate, however, that prior art multiplier 10 exhibits the highest noise levels when the gain is set to zero—precisely the opposite of what is needed to maintain a high signal-to-noise ratio (SNR). When the gain is at −1 (Ia=0; Ib=2Id), all signal current is routed through transistors Q2 and Q3. While this provides full signal gain, nevertheless the differential signal transistor pairs Q1/Q2 and Q3/Q4 have no differential gain relative to their own noise. Accordingly, as Q1 and Q4 are gradually turned on and Q2/Q3 are gradually turned off, the signal gain approaches zero. When all transistors have equal amounts of signal current flowing through them, zero net input signal passes to the output and the signal gain thus is zero. However, differential signal transistor pairs Q1/Q2 and Q3/Q4 are balanced and thus have maximum differential gain of their own noise. The single-ended output noise current of this circuit is described by formula 1 as follows.

$$i_{ns} = \sqrt{2\cdot\left[\frac{n_b}{\left(\frac{1}{gm1}+\frac{1}{gm2}\right)}\right]^2 + 2\cdot\left[\frac{n_b}{\left(\frac{1}{gm3}+\frac{1}{gm4}\right)}\right]^2} \quad (1)$$

where $I_{ns}$ is the single-ended output noise current and nb is the noise voltage due to base resistance. Substituting for the trans-conductance terms gmx (where x=1–4) of the transistors, the single-ended output noise current for signal gain (A) from −1 to +1 is described by formula 2 as follows.

$$i_{ns} = \frac{\frac{I_{tail}}{Vt} \cdot n_b}{\frac{1}{1-A} + \frac{1}{1+A}} \quad (2)$$

wherein Vt=kT/q is Boltzmann's constant times the absolute temperature divided by the charge on the electron.

Figure 3:
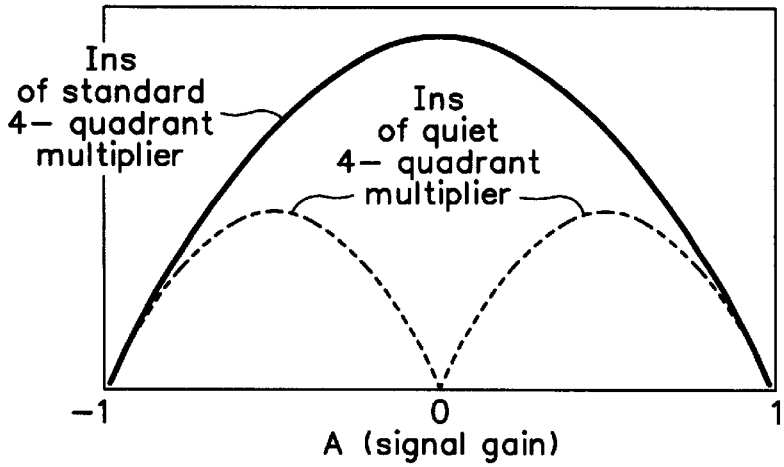
FIG. 3 is a graph illustrating the comparative output noise v. signal gain characteristics of the multipliers of FIGS. 1A and 2A.

Referring briefly to FIG. 3, the noise current plot based upon this formula illustrates the fact that the noise peaks when the gain is zero. As is pointed out above, this is undesirable since ideally the noise would be lowest when the gain is zero.

The invention now will be described by reference to FIG. 2A, in which identical elements having identical functions are designated by identically numbered reference designators and in which similar elements having similar functions are designated by primed, but otherwise identically numbered, reference designators. It will be appreciated that the low-noise multiplier to be described below avoids the prior art problem of high noise at zero gain by routing substantially zero current to the output when the signal gain is zero.

Figure 2A:
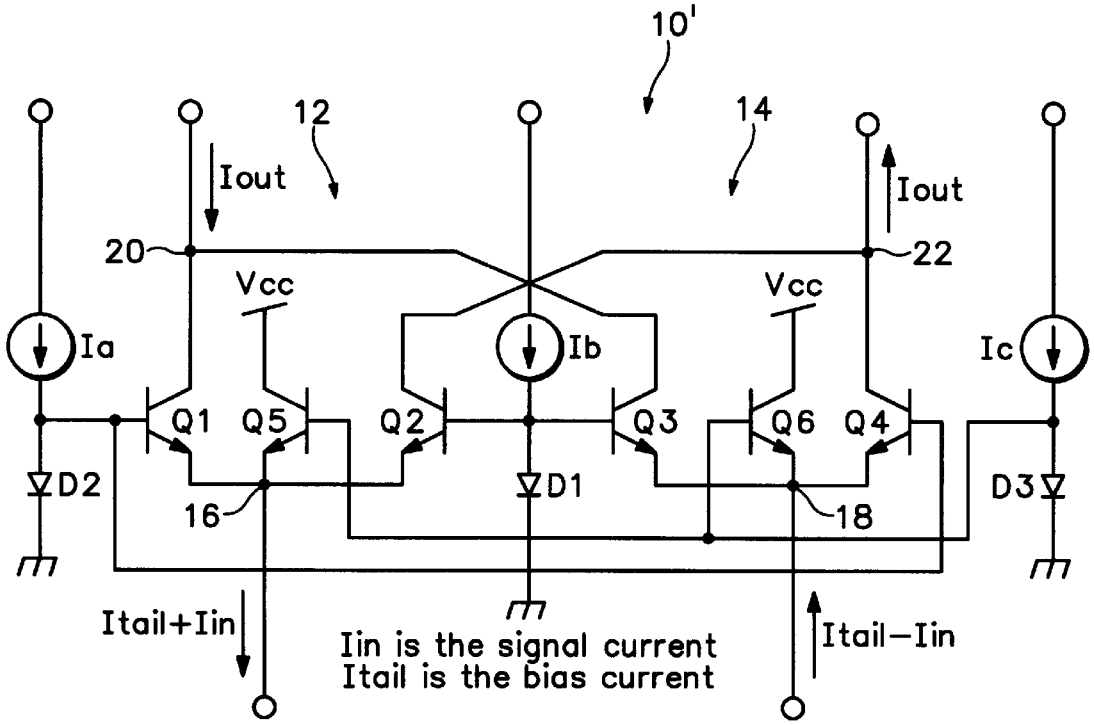
FIGS. 2A and 2B are a schematic diagram illustrating a low-noise four-quadrant multiplier made in accordance with a preferred embodiment of the invention and a graph illustrating its gain versus current characteristics.

FIG. 2A is a schematic diagram illustrating a preferred embodiment of invented low-noise four-quadrant multiplier at 10'. Transistor pairs Q1/Q2, Q3/Q4 (12, 14); first and second current sources Ib, Ia; diodes D1 and D2; first and second differential input terminals Itail+Iin, Itail−Iin; and first and second differential output terminals Iout1, Iout2 are identically configured as described above by reference to FIG. 1A. The overall structure and resulting performance of multiplier 10', however, is different and much improved, as will be seen. Multiplier 10' may be thought of as having first and second cross-coupled pairs of differential transistors Q1/Q2 and Q3/Q4; differential input current terminals Itail+Iin, Itail−Iin connected with a first pair of common junctions 16, 18 of the respective pairs of differential transistors; and differential output current terminals Iout cross coupled to form a second pair of common junctions 20,22 of the respective pairs of differential transistors.

Low-noise four-quadrant multiplier 10' may be seen to further include a transistor pair Q5/Q6 operatively connected to first and second differential transistor pairs Q1/Q2 and Q3/Q4, respectively. Collectors C5/C6 of transistor pair Q5/Q6 are connected to a bias voltage, e.g. Vcc, as shown. Emitters E5/E6 of transistor pair Q5/Q6 are connected in common with emitters E1/E2 and E3/E4 of the respective differential transistor pairs Q1/Q2 and Q3/Q4 to first and second differential input terminals Itail+Iin and Itail−Iin. Bases B5, B6 of transistor pair Q5/Q6 are connected in common to a third current source Ic and through a third diode D3 to a baseline voltage, e.g. ground.

In low-noise multiplier 10', again the gain is −1 when all of the signal current flows through transistors Q2 and Q3. The difference here is that, in order to achieve zero gain, current is gradually routed to Vcc rather than being subtracted from the output. The gain is zero when all of the signal current is flowing through transistor pair Q5/Q6 into Vcc, i.e. when signal current is shunted away from differential output terminals Iout. Those of skill in the art will appreciate that the result is zero or negligible noise at zero gain and at maximum gain (A=−1 and A=+1) and reduced overall noise. The single-ended output noise current for low-noise multiplier for signal gain from −1 to 0 is described by formula 3 below.

$$i_{ns} = \frac{\frac{I_{tail}}{V_t} \cdot n_b}{\frac{1}{-A} + \frac{1}{1+A}} \quad (3)$$

Because of the symmetry of invented multiplier 10', the shape of this curve repeats itself for A from 0 to +1, as will be seen.

Figure 2B:
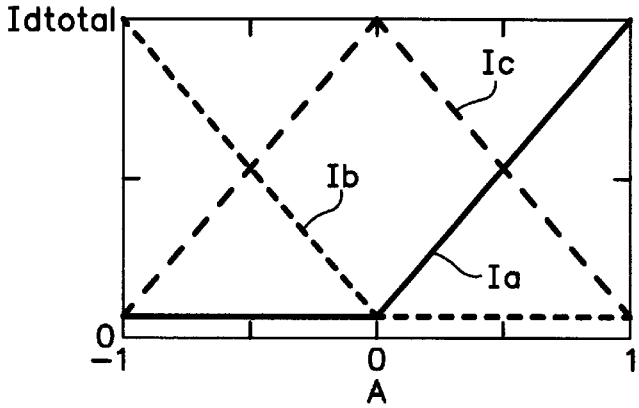

The gain A of low-noise four-quadrant multiplier 10' is determined by the diode currents according to the formula A=(Ia−Ib)/(Ia+Ib+Ic). The graph of FIG. 2B illustrates one simple method of setting the drive currents through current sources Ia (solid line), Ib (dotted line) and Ic (dashed line). Those of skill in the art will appreciate that again the current sources are linear and complimentary to one another, and that their combination determines the gain of multiplier 10'. Each ranges between 0 and $Id_{total}$, wherein $Id_{total}$ is the total current through diodes D2, D1 and D3. Thus, complementary control of Ia, Ib and Ic may be seen linearly to control gain A of multiplier 10'.

Those of skill in the art will appreciate that the graph in FIG. 2B is only one example of control currents, and other examples will also suffice. For example, the sharp corners need not be precisely realized in a typical physical embodiment of low-noise four-quadrant multiplier 10'. Those of skill also will appreciate that current sources Ia and Ib that may have slightly rounded corners (not shown) (at the bottom center of the graph) and nevertheless still tend to cancel one another. Accordingly, low-noise four-quadrant multiplier 10' will be understood to be tolerant of an imprecisely controlled Ia, Ib and Ic and thus to produce a substantially linear current multiplying function even in the event of a less than ideal implementation of the controlling currents shown in FIG. 2B.

Skilled persons will appreciate also that field-effect transistors (FETs) may be substituted in certain applications, e.g. mixers, for the bipolar transistors of the preferred embodiment. Such a substitution involves changing the configuration of the control circuit (comprising current sources Ia, Ib and Ic and diodes D2, D1, and D3) so that the FETs' characteristic operation is properly compensated. Such an alternative implementation is contemplated, and is within the spirit and scope of the invention.

FIG. 3 illustrates the comparative output noise v. signal gain characteristics of multipliers 10 and 10'. The solid line shows the relative output noise current of prior art four-quadrant multiplier 10 for gains from −1 to +1. The dotted line shows how the output noise current of invented low-noise multiplier 10' is reduced by approximately one half (on average and in peak value), and is substantially reduced to zero when the signal gain A is 0, as desired. Those of skill in the art will appreciate that the graph of FIG. 3 is somewhat idealized, and that the noise when the gain is zero may not quite reach 0. Nevertheless, in most implementations, the noise at zero gain is substantially zero, e.g. it is negligible, and thus realizes the advantages of the invention in a broad variety of multiplying applications.

The method of the invention now may be understood to involve reducing noise in a four-quadrant multiplier. Those of skill will appreciate that prior art multiplier 10 has first and second cross-coupled pairs of differential transistors. Multiplier 10 also has differential input current terminals connected with common emitters of the respective pairs of differential transistors. Finally, multiplier 10 has its differential output current terminals connected with common collectors of the respective pairs of differential transistors.

The invented noise reduction method may be seen to involve providing a noise current path from the differential input current terminals to a bias voltage, with the noise current path substantially bypassing the differential output current terminals when the gain of the amplifier is substantially zero. Preferably, this provision is of a third pair of transistors Q5/Q6 having respective emitters (or sources) connected to the common emitters (or common sources) of the respective cross-coupled pairs of differential transistors; common collectors (or common drains) connected to a bias voltage; and common bases (or common gates) connected to a suitable control voltage, e.g. from a current source flowing through a diode to a baseline voltage, e.g. ground. Those of skill in the art will appreciate that realizing the method of the invention may be accomplished in alternative ways contemplated herein. For instance, other circuitry may be substituted for the current sources and diodes to provide the appropriate control voltages to the bases (or gates) of bipolar (or field-effect) transistors Q1/Q4, Q2/Q3, and Q5/Q6. Thus, all such variations in noise reduction methodology are within the spirit and scope of the invention.

Finally, those of skill in the art will appreciate that the invented method and apparatus described and illustrated herein may be implemented in hardware of any suitable configuration, topology and circuit and device detail. Preferably, the apparatus is implemented as described and illustrated herein, for purposes of low component count, low cost and high performance. Alternative embodiments are contemplated, however, and are within the spirit and scope of the invention.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A method of reducing noise in a four-quadrant multiplier having first and second cross-coupled pairs of differential transistors, differential input current terminals connected with a first pair of common junctions of the respective pairs of differential transistors and differential output current terminals cross coupled to form a second pair of common junctions of the respective pairs of differential transistors, the method comprising:

providing a noise current path from the differential input current terminals to a bias voltage, said noise current path substantially bypassing the differential output current terminals when the gain of the multiplier is substantially zero;

said transistors being bipolar transistors and said first pair of common junctions are common emitter junctions and said second pair of common junctions are common collector junctions, wherein said providing is of a third pair of transistors having respective emitters connected to the common emitter junctions of the respective pairs of differential transistors, common collectors connected to a bias voltage without intervening elements, and common bases connected to a control voltage.

2. The method of claim 1 in which the transistors are bipolar transistors and in which the first pair of common junctions are common emitter junctions and the second pair of common junctions are common collector junctions, wherein said providing is of a third pair of transistors having respective emitters connected to the common emitter junctions of the respective pairs of differential transistors, common collectors connected to a bias voltage and common bases connected to a control voltage.

3. The method of claim 1, wherein the control voltage is derived from a current source flowing through a diode to a baseline voltage.

4. A method of reducing noise in a four-quadrant multiplier having first and second cross-coupled pairs of differential transistors, differential input current terminals connected with a first pair of common junctions of the respective pairs of differential transistors and differential output current terminals cross coupled to form a second pair of common junctions of the respective pairs of differential transistors, the method comprising:

providing a noise current path from the differential input current terminals to a bias voltage, said noise current path substantially bypassing the differential output current terminals when the gain of the multiplier is substantially zero;

wherein the transistors are field-effect transistors (FETs) and in which the first pair of common junctions are common source junctions and the second pair of common junctions are common drain junctions, wherein said providing is of a third pair of transistors having respective sources connected to the common source junctions of the respective pairs of differential transistors, common drains connected to a bias voltage without intervening elements, and common gates connected to a control voltage.

5. The method of claim 4, wherein the control voltage is derived from a current source flowing through a diode to a baseline voltage.

6. In a four-quadrant multiplier comprising a first differential transistor pair Q1/Q2 having emitters connected together to form an emitter junction connected in turn to a first differential input terminal, with Q1 having a collector connected to a first differential output terminal and with Q2 having a collector connected to a second differential output terminal, a second differential transistor pair Q3/Q4 having emitters connected together to form an emitter junction connected in turn to a second differential input terminal, with Q3 having a collector connected to said first differential output terminal and with Q4 having a collector connected to said second differential output terminal wherein the bases of transistors Q2 and Q3 are connected in common to a first control voltage and the bases of transistors Q1 and Q4 being connected in common to a second control voltage, the improvement comprising:

a transistor pair Q5 and Q6 operatively connected to said first and second differential transistor pairs Q1/Q2 and Q3/Q4, respectively, said transistor pair Q5 and Q6 having collectors connected to a bias voltage;

emitters of said transistor pair Q5 and Q6 connected in common with the emitters of the respective differential transistor pairs to said first and second differential input terminals; and bases of said transistor pair Q5 and Q6 connected in common to a third control voltage;

said transistor pair Q5 and Q6 conducting current from the emitter junctions of the respective differential transistor pairs to the bias voltage without intervening elements thereby to achieve low noise at low gain.

7. The improvement of claim 6, wherein the first, second, and third control voltages are derived from first, second, and third current sources flowing through first, second, and third diodes respectively to a baseline voltage.

8. The improvement of claim 7, wherein the operating characteristics of transistor pair Q5 and Q6 are substantially matched with one another.

9. The improvement of claim 7, wherein the sum of the currents from said first, second and third current sources is substantially constant over a gain range of the multiplier between −1 and +1 and wherein the third current source provides maximum current when the first and second current sources provide minimum current at substantially zero gain.

10. Low-noise four-quadrant multiplier apparatus comprising:

a first differential transistor pair Q1/Q2 having emitters commonly connected to a first differential input terminal, with Q1 having a collector connected to a first differential output terminal and with Q2 having a collector connected to a second differential output terminal;

a second differential transistor pair Q3/Q4 having emitters connected in common to a second differential input terminal, with Q3 having a collector connected to said first differential output terminal and with Q4 having a collector connected to said second differential output terminal;

bases of said transistors Q2 and Q3 being connected in common to a first control voltage, bases of transistors Q1 and Q4 being connected in common to a second control voltage;

a transistor pair Q5/Q6 operatively connected to said first and second differential transistor pair, respectively, said transistor pair Q5/Q6 having collectors connected to a bias voltage without intervening elements, emitters connected with the emitters of the respective differential transistor pairs to said first and second differential input terminals and bases connected to a third control voltage.

11. The apparatus of claim 10, wherein the first, second, and third control voltages are derived from first, second, and third current sources flowing through first, second, and third diodes respectively to a baseline voltage.

12. The apparatus of claim 10, wherein the operating characteristics of transistor pair Q5/Q6 are substantially matched with one another.

13. The apparatus of claim 11, wherein the sum of the currents from said first, second and third current sources is substantially constant over a gain range of the multiplier between −1 and +1 and wherein the third current source provides maximum current when the first and second current sources provide minimum current at substantially zero gain.

14. In four-quadrant multiplier apparatus comprising a first differential transistor pair Q1/Q2 having sources connected together to form a source junction connected in turn to a first differential input terminal, with Q1 having a drain connected to a first differential output terminal and with Q2 having a drain connected to a second differential output terminal, a second differential transistor pair Q3/Q4 having sources connected together to form a source junction connected in turn to a second differential input terminal, with Q3 having a drain connected to said first differential output terminal and with Q4 having a drain connected to said second differential output terminal wherein the gates of transistors Q2 and Q3 are connected in common to a first control voltage and the gates of transistors Q1 and Q4 are connected in common to a second control voltage, the improvement comprising:

a transistor pair Q5 and Q6 operatively connected to said first and second differential transistor pairs Q1/Q2 and Q3/Q4, respectively, said transistor pair Q5 and Q6 having drains connected to a bias voltage without intervening elements;

sources of said transistor pair Q5 and Q6 connected in common with the sources of the respective differential transistor pairs to said first and second differential input terminals; and gates of said transistor pair Q5 and Q6 connected in common to a third control voltage;

said transistor pair Q5 and Q6 conducting current from the source junctions of the respective differential transistor pairs to the bias voltage thereby to achieve low noise at low gain.

15. The apparatus of claim 14, wherein the first, second, and third control voltages are derived from first, second, and third current sources flowing through first, second, and third diodes respectively to a baseline voltage.

16. The apparatus of claim 14, wherein the operating characteristics of transistor pair Q5 and Q6 are substantially matched with one another.

17. The apparatus of claim 15, wherein the sum of the currents from said first, second and third current sources is substantially constant over a gain range of the multiplier between −1 and +1 and wherein the third current source provides maximum current when the first and second current sources provide minimum current at substantially zero gain.

* * * * *